US009049943B2

(12) United States Patent
Caminade et al.

(10) Patent No.: US 9,049,943 B2
(45) Date of Patent: Jun. 9, 2015

(54) MATTRESS STRUCTURE INCLUDING LOW AIR LOSS

(71) Applicant: Hill-Rom Industries SA, Montpellier (FR)

(72) Inventors: Jean-Luc Caminade, Saint Jean de Vedas (FR); Jean-Marie Basilio, Meze (FR); Olivier Coupard, Montpellier (FR)

(73) Assignee: Hill-Rom Industries SA, Montpellier (FR)

( * ) Notice: Subject to any disclaimer, the term of this patent is extended or adjusted under 35 U.S.C. 154(b) by 0 days.

(21) Appl. No.: 13/932,545

(22) Filed: Jul. 1, 2013

(65) Prior Publication Data

US 2014/0000040 A1 Jan. 2, 2014

Related U.S. Application Data

(63) Continuation of application No. 12/249,998, filed on Oct. 13, 2008, now abandoned.

(30) Foreign Application Priority Data

Oct. 18, 2007 (FR) ..... 07 58411

(51) Int. Cl.
*A47C 27/08* (2006.01)
*A61G 7/057* (2006.01)

(52) U.S. Cl.
CPC ..... *A47C 27/083* (2013.01); *A61G 7/05776* (2013.01); *A61G 2203/34* (2013.01)

(58) Field of Classification Search
CPC ..... A47C 27/083; A61G 7/05776; A61G 2203/34
USPC ..... 5/706, 710–713, 655.3
See application file for complete search history.

(56) References Cited

U.S. PATENT DOCUMENTS 1,726,939 A 9/1929 Anderson
2,728,926 A 1/1956 Emery (Continued)

FOREIGN PATENT DOCUMENTS

DE 202 19 638 U1 4/2003
DE 20 2004 002 763 7/2004

(Continued)

OTHER PUBLICATIONS

Search report in related EP 08 16 6634 dated Apr. 1, 2009.

(Continued)

*Primary Examiner* — Peter M Cuomo
*Assistant Examiner* — Brittany Wilson
(74) *Attorney, Agent, or Firm* — Barnes & Thornburg LLP

(57) ABSTRACT

An inflatable cell that is inflatable with a fluid, such as air, comprises a flexible casing that is closed at its ends, the casing defining, between its walls, at least one inflatable chamber; and at least one fluid insertion means for inserting fluid into the chamber and at least one fluid removal means for removing fluid from said chamber, these insertion and removal means being bonded in substantially airtight manner to at least one end of the casing; and at least one link means for linking the cell to another identical cell, which link means are integral with or secured to the casing. A method of manufacturing such a cell and a support device of the mattress type that is manufactured on the basis of assembling together such cells are also disclosed.

17 Claims, 5 Drawing Sheets

(56) References Cited

U.S. PATENT DOCUMENTS

| | | | | | |
|---|---|---|---|---|---|
| 2,731,652 | A | * | 1/1956 | Bishop | 5/710 |
| 4,193,149 | A | | 3/1980 | Welch | |
| 4,225,989 | A | | 10/1980 | Corbett et al. | |
| 4,255,824 | A | | 3/1981 | Pertchik | |
| 4,638,519 | A | | 1/1987 | Hess | |
| 4,729,598 | A | | 3/1988 | Hess | |
| 4,797,962 | A | | 1/1989 | Goode | |
| 4,823,417 | A | | 4/1989 | Fukuichi | |
| 4,888,958 | A | | 12/1989 | Ella | |
| 4,896,389 | A | | 1/1990 | Chamberland | |
| 4,914,771 | A | | 4/1990 | Afeyan | |
| 4,944,060 | A | | 7/1990 | Peery et al. | |
| 4,949,412 | A | | 8/1990 | Goode | |
| 4,949,413 | A | | 8/1990 | Goodwin | |
| 4,949,414 | A | | 8/1990 | Thomas et al. | |
| 4,953,247 | A | | 9/1990 | Hasty | |
| 5,003,654 | A | | 4/1991 | Vrzalik | |
| 5,005,240 | A | | 4/1991 | Vrzalik | |
| 5,022,110 | A | | 6/1991 | Stroh | |
| 5,035,014 | A | | 7/1991 | Blanchard | |
| 5,035,016 | A | | 7/1991 | Mori et al. | |
| 5,044,029 | A | | 9/1991 | Vrzalik | |
| 5,044,030 | A | * | 9/1991 | Balaton | 5/710 |
| 5,052,067 | A | | 10/1991 | Thomas et al. | |
| 5,062,167 | A | | 11/1991 | Thomas et al. | |
| 5,065,466 | A | | 11/1991 | Thomas et al. | |
| 5,073,999 | A | | 12/1991 | Thomas et al. | |
| 5,090,077 | A | | 2/1992 | Caden et al. | |
| 5,095,568 | A | | 3/1992 | Thomas et al. | |
| 5,121,513 | A | | 6/1992 | Thomas et al. | |
| 5,152,021 | A | | 10/1992 | Vrzalik | |
| 5,249,318 | A | | 10/1993 | Loadsman | |
| 5,251,347 | A | | 10/1993 | Hopper et al. | |
| 5,251,349 | A | | 10/1993 | Thomas et al. | |
| 5,267,364 | A | | 12/1993 | Volk | |
| 5,269,030 | A | | 12/1993 | Pahno et al. | |
| 5,272,778 | A | | 12/1993 | Gore | |
| 5,301,457 | A | | 4/1994 | Seely | |
| 5,305,483 | A | | 4/1994 | Watkins | |
| 5,412,822 | A | | 5/1995 | Kelly | |
| 5,438,721 | A | | 8/1995 | Pahno et al. | |
| 5,483,709 | A | | 1/1996 | Foster et al. | |
| 5,493,742 | A | | 2/1996 | Klearman | |
| 5,509,155 | A | | 4/1996 | Zigarac et al. | |
| 5,513,406 | A | | 5/1996 | Foster et al. | |
| 5,539,942 | A | | 7/1996 | Melou | |
| 5,560,057 | A | | 10/1996 | Madsen et al. | |
| 5,564,142 | A | * | 10/1996 | Liu | 5/689 |
| 5,586,346 | A | | 12/1996 | Stacy et al. | |
| 5,603,133 | A | | 2/1997 | Vrzalik | |
| 5,606,754 | A | | 3/1997 | Hand et al. | |
| 5,634,225 | A | * | 6/1997 | Miller et al. | 5/710 |
| 5,647,078 | A | * | 7/1997 | Pekar | 5/706 |
| 5,647,079 | A | | 7/1997 | Hakamiun et al. | |
| 5,651,151 | A | | 7/1997 | Schild | |
| 5,699,570 | A | | 12/1997 | Wilkinson et al. | |
| 5,704,084 | A | | 1/1998 | Evans et al. | |
| 5,727,270 | A | | 3/1998 | Cope et al. | |
| 5,729,853 | A | | 3/1998 | Thompson | |
| 5,755,000 | A | | 5/1998 | Thompson | |
| 5,774,917 | A | | 7/1998 | Liu | |
| 5,787,534 | A | | 8/1998 | Hargest et al. | |
| 5,794,288 | A | | 8/1998 | Soltani et al. | |
| 5,797,962 | A | | 8/1998 | Tomihata et al. | |
| 5,809,597 | A | | 9/1998 | Shaw | |
| 5,815,864 | A | | 10/1998 | Sloop | |
| 5,882,349 | A | | 3/1999 | Wilkerson et al. | |
| 5,890,245 | A | | 4/1999 | Klearman et al. | |
| 5,911,657 | A | | 6/1999 | Meiners | |
| 5,926,884 | A | | 7/1999 | Biggie et al. | |
| 5,963,997 | A | | 10/1999 | Hagopian | |
| 5,970,550 | A | | 10/1999 | Gazes | |
| 5,983,429 | A | | 11/1999 | Stacy et al. | |
| 6,012,186 | A | | 1/2000 | Soltani et al. | |
| 6,015,471 | A | | 1/2000 | Rimington et al. | |
| 6,062,215 | A | | 5/2000 | Leininger et al. | |
| 6,073,291 | A | | 6/2000 | Davis | |
| 6,085,372 | A | | 7/2000 | James | |
| 6,115,860 | A | | 9/2000 | Vrzalik | |
| 6,122,786 | A | | 9/2000 | Ball | |
| 6,134,732 | A | | 10/2000 | Chapman et al. | |
| 6,148,461 | A | | 11/2000 | Cook et al. | |
| 6,212,718 | B1 | | 4/2001 | Stolpmann et al. | |
| 6,282,737 | B1 | | 9/2001 | Vrzalik | |
| 6,317,912 | B1 | | 11/2001 | Graebe et al. | |
| 6,421,859 | B1 | | 7/2002 | Hicks et al. | |
| 6,457,197 | B1 | | 10/2002 | Wu | |
| 6,487,739 | B1 | | 12/2002 | Harker | |
| 6,499,166 | B1 | | 12/2002 | Jones | |
| 6,536,056 | B1 | | 3/2003 | Vrzalik et al. | |
| 6,618,884 | B1 | | 9/2003 | Wu | |
| 6,687,937 | B2 | | 2/2004 | Harker | |
| 6,691,355 | B1 | | 2/2004 | Liu | |
| 6,694,557 | B1 | | 2/2004 | Bobey et al. | |
| 6,698,046 | B1 | | 3/2004 | Wu | |
| 6,708,352 | B2 | | 3/2004 | Salvatini et al. | |
| 6,730,115 | B1 | | 5/2004 | Heaton | |
| 6,745,996 | B1 | | 6/2004 | Guthrie | |
| 6,782,574 | B2 | | 8/2004 | Totton et al. | |
| 6,820,640 | B2 | | 11/2004 | Hand et al. | |
| 6,855,158 | B2 | | 2/2005 | Stolpmann | |
| 6,892,405 | B1 | | 5/2005 | Dimitriu et al. | |
| 6,942,687 | B1 | | 9/2005 | Heaton et al. | |
| 7,036,171 | B2 | | 5/2006 | Wu | |
| 7,086,104 | B1 | | 8/2006 | Tsay | |
| 7,107,640 | B2 | | 9/2006 | Chapman et al. | |
| 7,171,711 | B2 | * | 2/2007 | Gowda | 5/713 |
| 7,234,184 | B2 | | 6/2007 | Yang | |
| 7,296,315 | B2 | | 11/2007 | Totton et al. | |
| 7,412,738 | B2 | | 8/2008 | Chaffee | |
| 7,454,809 | B2 | | 11/2008 | Gowda | |
| 8,533,879 | B1 | * | 9/2013 | Taylor | 5/713 |
| 2002/0073489 | A1 | | 6/2002 | Totton et al. | |
| 2002/0138910 | A1 | | 10/2002 | Boyd | |
| 2002/0195144 | A1 | | 12/2002 | Hand et al. | |
| 2003/0046762 | A1 | | 3/2003 | Stolpmann | |
| 2003/0084511 | A1 | | 5/2003 | Salvatini et al. | |
| 2004/0031103 | A1 | | 2/2004 | Wyatt et al. | |
| 2004/0128772 | A1 | * | 7/2004 | Branson et al. | 5/713 |
| 2004/0177450 | A1 | | 9/2004 | Salvatini et al. | |
| 2004/0256588 | A1 | | 12/2004 | Guthrie | |
| 2005/0022308 | A1 | | 2/2005 | Totton et al. | |
| 2005/0091752 | A1 | | 5/2005 | Gowda | |
| 2006/0156473 | A1 | | 7/2006 | Chambers et al. | |
| 2006/0272097 | A1 | * | 12/2006 | Dionne et al. | 5/713 |
| 2007/0101506 | A1 | | 5/2007 | Pirzada | |
| 2007/0234482 | A1 | | 10/2007 | Wright | |

FOREIGN PATENT DOCUMENTS

| | | |
|---|---|---|
| EP | 0 910 975 A2 | 4/1999 |
| WO | WO 96/10938 | 4/1996 |

OTHER PUBLICATIONS

French Search Report for FR 0758411 (6 pabes) Aug. 7, 2008.
US 5,152,022, 10/1992, Vrzalik (withdrawn)

* cited by examiner

MATTRESS STRUCTURE INCLUDING LOW AIR LOSS

The present application is a continuation of U.S. application Ser. No. 12/249,998, filed Oct. 13, 2008, which claims priority, under 35 U.S.C. §119(a), of French National Application No. 07 58411 which was filed Oct. 18, 2007 and each of which is hereby incorporated by reference herein.

BACKGROUND

The present disclosure relates to support devices of the mattress type or of the cushion type for supporting the body of a person sitting or lying on the support device, and in particular to support devices of the therapeutic mattress type for supporting patients' bodies. The present disclosure relates more particularly to an inflatable cell and to a method of manufacturing such an inflatable cell, the cell and the method being specifically developed for making a support device having a structure made up, at least in part, of a plurality of inflatable cells that are suitable for being inflated with a fluid, and in particular inflated with air, that are, more particularly, in the form of sausage-shaped tubes, and that are disposed transversely relative to the longitudinal direction of the mattress, side-by-side, so as to form an inflatable support layer on which a person can be recumbent and be supported under desired comfort conditions.

Support devices of this type are, in particular, used as mattresses for patient care because they make it possible, by means of a device for regulating the inflation/deflation of the cells, to distribute appropriately the interface pressures, i.e. the pressures exerted locally by each point of the body on the surface of the mattress, as a function of the morphology and of the position of the patient, and thus to avoid or to reduce the risks of decubitus ulcers or "bedsores" forming in the zones of the body that are at risk such as the zone of the sacrum and the zone of the heels, for example.

A large number of devices of this type are known and described in various forms in the state of the art. However, those support devices having structures that are inflatable, at least in part, all suffer from the drawback of being very costly to manufacture, which limits their field of use to hospitals, and indeed sometimes to only certain departments of hospitals for admitting and treating patients having very reduced mobility and/or having high risks of developing bedsores.

The cost of manufacturing such support devices is, in particular, related to manufacturing their structural elements, and in particular the inflatable cells, and also the systems for automatically inflating said cells, which systems require implementation of a large number of ducts and of valves for feeding and/or removing air so as to enable the cells to be inflated and then for their inflation pressures to be regulated.

The high cost of such support devices having inflatable cells currently rules out the use of such support devices for the vast majority of patients receiving healthcare treatment at home because public and private health insurance schemes generally refuse to pay or to reimburse the costs inherent to purchasing and using such devices.

And yet giving healthcare treatment at home is a form of healthcare treatment that is increasingly being encouraged by the very same public and private health insurance schemes because it makes it possible to reduce considerably the healthcare costs related to prolonged periods in a hospital or to repeated spells in a hospital, or even makes it possible to avoid having to admit to a hospital at all patients who can, by means of progress in medical techniques, henceforth be treated as outpatients.

There thus exists a major technical problem consisting in designing and making a support device made up of inflatable cells whose cost is low enough to be borne by patients and/or covered by their healthcare cover systems so as to enable them to be treated at home.

Such a problem requires, in particular, the cost of each of the component elements of support devices having inflatable cells to be reduced, in particular the cost of the cells themselves, and also requires the structures of such support devices to be simplified so as to facilitate assembly of them and thus so as to reduce the cost of manufacturing them.

Another problem is to provide a support device made up of inflatable cells that improve the support of the mattress and the comfort of the patient, and that are suitable for being assembled together and, when necessary, replaced individually so as to form a support device of the mattress type.

SUMMARY

The present disclosures provides a solution to these problems by providing, in a first aspect, an inflatable cell that is inflatable with a fluid, such as air, and that comprises: a flexible casing that is closed at its ends in its longitudinal direction, said casing defining, between its walls, at least one inflatable chamber that is substantially cylindrical in shape after inflation; and at least one fluid insertion means for inserting fluid into said chamber and at least one fluid removal means for removing fluid from said chamber, these insertion and removal means being bonded in airtight manner to at least one of said ends of the casing; and at least one link means for linking the cell to another identical cell, which means are integral with or secured to the casing.

The inflatable cell disclosed herein provides an individual and independent inflation chamber that incorporates into its structure means for inserting and removing an inflation fluid, and that, in addition includes link means for linking to another identical cell, thereby making it possible, by assembling together a plurality of cells, to make an inflatable support mattress of size adaptable to demand, and in which each cell is inflatable individually and can, in the event of failure, be replaced rapidly and simply with another identical cell, without replacing the entire mattress.

The cell disclosed herein also offers the feature of being made from a single casing that is bonded at its ends, thereby making it possible to make the cell in a single operation, at high rates, from a sheath or from a segment of tubular material, in particular by welding two opposite faces of the tubular wall of the sheath along lines that extend transversely relative to the axial longitudinal direction of said sheath so as to form the ends of the casing, thereby reducing the manufacturing cost considerably.

More precisely, according to an aspect of the present disclosure, the tubular casing may be constituted by a segment of tube or sheath made of an extruded thermoplastic material, which segment is closed at its ends by respective welds along respective lines that are optionally curved lines and that extend substantially transversely relative to the axial longitudinal direction of the sheath at said closed ends.

Thus, in some embodiments, the tubular casing is constituted by a segment of tube or sheath made of an extruded thermoplastic material, which segment is closed at its ends by welding, such as by heat-sealing or high-frequency welding, the tubular wall of said sheath to itself, the opposite faces of said tubular wall of said casing being welded transversely to one another at said closed end, i.e. substantially in the direction that is transverse to the longitudinal direction of said cell, so as to form or define ends optionally having a curved transverse profile.

The term "transversely" or "transverse direction" is used herein to mean a direction perpendicular to said axial longitudinal direction of said sheath and of the cells, corresponding to a diametrical direction when the sheath has a circular cross-section and corresponding more particularly to a vertical direction when said cells are assembled together side-by-side horizontally to form a mattress.

More particularly, the opposite faces of said tubular casing are welded to each other transversely in end zones beyond said closed ends of said casing.

More particularly, said fluid insertion means and said fluid removal means are constituted by tubular end-pieces welded at the weld of at least one of said closed ends of the casing, said end-pieces communicating with said inflatable chamber, said tubular end-pieces being interposed between the opposite faces of said tubular wall that are welded together transversely at said closed end.

According to other aspects of an inflation cell of the present disclosure: said link means are formed integrally with the tubular casing of the cell, in one of said welded end zones of the cell, such as in the form of a tongue extending beyond said closed end of the casing; and said link means are provided with or co-operate with reversible fastener means suitable for co-operating with identical link means or with identical reversible fastener means and/or with complementary reversible fastener means of another identical inflatable cell so as to make it possible to establish a reversible link between the cell and said other identical cell, and in some instances to establish reversible links between the cell and two other identical cells.

According to the present disclosure, the opposite faces of the tubular casing are bonded together by a longitudinal weld extending between said closed ends of the casing over a fraction of its length only, thereby separating said inflatable chamber into two inflatable compartments, namely an upper compartment and a lower compartment in the form of sausage-shaped tubes that are superposed and that communicate with each other at their ends.

This embodiment is particularly interesting because it makes it possible to provide cells that present depth or height in said vertical transverse direction that is larger than their width (dimension in the longitudinal direction of the mattress), thereby imparting greater rigidity to said cells, and thus greater stability, giving them strength for withstanding crushing and deformation under the effect of the weight of the patient on the mattress.

In some embodiments, two diametrically opposite faces of the tubular wall of the tubular casing are welded together longitudinally between said closed ends of the casing, substantially half-way up said casing, thereby separating said inflatable chamber into two inflatable compartments, namely an upper compartment and a lower compartment in the form of sausage-shaped tubes that are superposed and that are of substantially the same height.

This feature is desirable in some embodiments because it enables the cells to keep a width that is substantially constant over their entire length, and thus it is possible to implement a mattress made up of an assembly of individualized cells, connected together reversibly by reversible link means at their ends only, further contributing to improving the support offered by the mattress and the comfort of the patient.

When the cells of a mattress are secured to one another over their entire longitudinal sides, as is conventional, any variation in the volume of one cell, caused by pressure being applied to the cell, is passed on to the adjacent cells that are secured to it. Conversely, individualized cells of some embodiments contemplated herein deform independently from one another so that the zone made up of individualized cells matches more closely the shapes of the patient on it. However, it is desirable that said individualized cells have greater stability widthwise, regardless of their levels of inflation. That is why, in accordance with some embodiments of the present disclosure, the opposite longitudinal side faces of the tubular wall of each cell are tied together by tie means consisting of a longitudinal weld zone or line over a portion only of their length, thereby defining two superposed compartments that communicate with each other at their ends.

More particularly, the cell has at least two link means, each provided with reversible fastener means suitable for co-operating with identical reversible fastener means of another identical inflatable cell so as to make it possible to establish a reversible link between the cell and at least one said other identical cell, and in some instances to establish reversible links between the cell and at least two other identical cells.

Even more particularly, the two fluid insertion and fluid removal means are formed by tubular end-pieces that are typically rigid or semi-rigid, in a manner such that each of them opens out into said chamber at a different one of said upper and lower compartments.

In the present disclosure, the term "semi-rigid" is used to mean that said tubular end-pieces hold their shapes while also being suitable for being curved, in particular for being provided with bends, without kinking.

Even more particularly, facing each of said upper and lower compartments, the cell has: a fluid insertion means or a fluid removal means formed by a tubular end-piece bonded to the same end of the casing; and a link means formed at the end opposite from said fluid insertion means and from said fluid removal means.

In accordance with other features of an inflatable cell of the present disclosure, the casing is made of ethylene vinyl acetate (EVA) or of polyurethane (PUR), more particularly of thickness lying in the range 150 micrometers (μm) to 350 μm.

In another aspect of the present disclosure, a method of manufacturing such an inflatable cell is provided, comprising: a) selecting a segment of a tube or of a sheath made of a thermoplastic material and of determined length; and b) transversely welding together, such as by heat-sealing, the opposite faces of said segment of tube or of sheath so as to form said closed ends of the casing, and longitudinally welding together the opposite faces of the tubular wall of the casing of the cell substantially in a longitudinal zone or along a longitudinal straight line of said casing over a fraction only of the length of said cell so as to subdivide the inflatable chamber into two inflatable compartments that are superposed and that communicate at their ends; c) then cutting out the segment of tube or of sheath in the welded zones, beyond the boundaries of the transverse welds forming the closed ends of said casing defining said chamber, so as to obtain said inflatable cell.

The term "transversely" is used herein to mean a direction that is transverse relative to the axial longitudinal direction of said sheath, as defined above.

More particularly, in step b), said ends of said segment of tube or of sheath are transversely welded in a manner such as to form, in a single operation, the tubular casing that is closed at its two ends with said fluid insertion and removal means of the cell being assembled in airtight manner to one of said ends of the segment of tube or of sheath simultaneously with the welding, by interposing tubular end-pieces suitable for forming respectively at least one said fluid insertion means and at least one said fluid removal means between the opposite faces of the tubular wall of said portion of tube at at least one end before welding the ends of the casing over said tubular end-pieces.

Yet more particularly, in step b), the opposite faces of said tubular casing that are transversely welded together are welded together in end zones beyond the curved transverse weld lines forming said closed ends of said chamber; and in step c), the segment of tube or of sheath is cut out in the welded end zones in a manner such as to form said link means of the cell.

Yet more particularly, said link means are formed by cutting out a tongue, and forming perforations in said welded end zone.

Yet more particularly, the diametrically opposite faces of the tubular wall of the casing of the cell are welded together between its closed ends, substantially half-way up its height so as to subdivide the inflatable chamber into two inflatable compartments, namely an upper inflatable compartment and a lower inflatable compartment, which compartments are superposed and of substantially the same height.

The method disclosed herein makes it possible to make inflatable cells from a very long roll of a sheath or of a tube made of an extruded thermoplastic material, and thus to manufacture the inflatable cells on a mass-produced basis with a single operator, who merely has to position the fluid insertion and removal means at one end of the sheath or tube made of a plastics material before its walls are welded together locally so as, simultaneously, to form the casing of the cell, to weld said fluid insertion and removal means of the cell, and to form the attach or link means for attaching or linking the casing of the inflatable cell.

The method disclosed herein thus makes it possible to obtain very considerable productivity gains when manufacturing individual inflatable cells for support devices of the mattress type, and thus a very considerable reduction in production and labor costs for such manufacturing.

Finally, in another aspect, the present disclosure contemplates a support device for supporting an element to be supported, in particular a mattress or a cushion for supporting a patient's body, said support device being made up of at least two individualized inflatable cells as discussed above, assembled together by means of a said link means.

More particularly, the support device is made up of a plurality p of individualized inflatable cells disposed side-by-side, one after the other, in the longitudinal direction of the mattress, and extending in a direction transverse to the longitudinal direction of the mattresses, where p is an integer lying in the range 2 to n, p and n being integers, the individualized inflatable cells being secured to one another by means of the respective link means being secured together, and communicating fluidly, such as pneumatically, with one another via fluid or pneumatic connection means comprising pipes or tubular fittings suitable for conveying and for transferring, as applicable, the inflation fluid between said fluid insertion means of some cells and said fluid removal means of other cells, to which means the pipes or tubular fittings are connected.

The phrase "individualized inflatable cells" is used herein to mean cells that are made singly and independently, and that are connected one to another, optionally reversibly; in particular by said link means and optionally by pipes enabling fluid, in particular air, to flow between the various cells and connected to a device for feeding air to and for regulating the inflation pressures of the cells. Thus, said individualized cells can be replaced singly. In addition, since said individualized cells are not secured to one another over their entire length, they have and impart greater freedom of movement in order to match more closely the curves and shapes of the patient.

When the consecutive cells disposed transversely relative to the longitudinal direction of the mattress are secured to one another along their entire longitudinal sides, as is conventional, any variation in the volume of one cell, caused by pressure being applied to the cell, is passed on to the adjacent cells that are secured to it. Conversely, individualized cells connected together at their ends only, in accordance with some embodiments disclosed herein, deform independently from one another so that the zone made up of individualized cells matches more closely the shapes of the patient on it. But, since they are made in individualized manner, some of the cells contemplated herein have greater stability widthwise, regardless of their levels of inflation, compared with juxtaposed cells that are welded together over their entire length.

That is why, in accordance with some embodiments of the present disclosure, the opposite side faces of each cell are connected together by tie means constituted by a longitudinal weld extending over a portion of the length of said cells, and not reaching their ends, said weld optionally being situated substantially in the middle relative to the height of the cell, giving the cells a width that is substantially constant regardless of their level of inflation.

More particularly, in accordance with some embodiments contemplated by the present disclosure, in at least one support zone, such as a substantially central zone designed to support the sacrum zone of a said person's body, and, in some instances a zone at which a sensor is situated, said support device is made up of a plurality of inflatable elements that are of a width smaller than their height, the width of said individualized inflatable elements of said central support zone also, even more particularly, being smaller than the width of the non-individualized inflatable elements of an end zone adjacent to said central support zone.

At least in its central support zone, the support device of such embodiments presents a greater density of cells so that there is reduced risk of the patient sinking through the cells, in particular in the event of deflation when the cells are inflated in an alternating-pressure mode.

The feature of the cells being individualized taken in combination with their width being stabilized and optionally smaller in said zone contributes to improving the support imparted by this zone and the comfort of the patient. This makes it possible to increase the number of support points procured by the inflatable elements and to enhance their distribution in said support zone when a person's body is on the upper layer of the device.

Even more particularly, over at least one zone of the mattress, said consecutive cells are disposed in opposite directions with their air insertion and air removal means being disposed on opposite sides in the transverse direction of the mattress, so that said zone of the mattress comprises two first and second series of cells, each of said first and second series of cells being made up of cells having their fluid insertion and removal means on the same side in the transverse direction of the mattress and communicating fluidly, such as pneumatically, with one another continuously, said removal means of one cell being connected to a said insertion means of the next cell of the same series, namely the first or the second series, the first and second series of cells being connected in parallel and fed by the same inflation device, both of said series of cells comprising the same number of cells, with the cells being disposed in alternation from one series to the other in the longitudinal direction of the mattress in said zone, a cell from said first or second series being preceded and/or followed by a cell from said second or first series respectively.

According to some embodiments contemplated by this disclosure, in said zone of the mattress, said consecutive cells have their link means disposed at an end opposite from the end at which said fluid insertion and removal means are disposed, so that each cell of each of said first and second series of cells made up of cells having their link means on the same side in the transverse direction of the mattress is linked by said link means to the following cell in the same series, and also in some embodiments where applicable, to the adjacent cell of the other series.

This embodiment is more particularly useful, in particular when said and first and second series are inflated in the alternating mode, because it makes it possible to reduce the space occupied by the fluid connection pipes between the various cells disposed along the mattress, on either side of the mattress.

According to other features, a support device in accordance with the present disclosure further comprises:

an inflation device co-operating with at least one fluid feed duct connected to a said fluid insertion means of at least one said cell; and/or at least one fluid removal duct connected to a said fluid removal means of at least one other said cell; and/or at least one solenoid valve making it possible to control fluid feed and/or fluid removal for said cells; and/or the support device is provided with an electronic control and regulation device making it possible to control at least two said solenoid valves and said inflation device so as to cause inflation and/or deflation to take place, such as in an alternating manner, for the two first and second series of cells in at least one said zone of the mattress; and/or the support device is also provided with a device of the manual valve type for deflating at least some of said inflatable cells in an emergency, said device of the manual valve type comprising:

a fastener first piece provided with a plurality of rigid first end-pieces perforated with through cylindrical orifices, said rigid first end-pieces co-operating with said removal means of said cells, such as for example, said perforated rigid first end-pieces being inserted into said tubular end-pieces forming said removal means, or said perforated rigid first end-pieces being inserted into the ends of fluidic or in some instances pneumatic transfer pipes communicating at their other ends with said removal means of a plurality of said cells, so as to enable at least one zone of cells of said mattress to be deflated; and a removable second piece including second end-pieces suitable for being fitted in said first orifices of said perforated rigid first end-pieces so as to form removable stoppers closing off said first orifices, and a handle suitable for being pulled manually so as to extract said second end-pieces from said orifices in said first end-pieces, and so as to make it possible for said cells to be deflated rapidly for such emergency purposes;

said second end-pieces of said removable piece are provided with second through cylindrical orifices closed off in substantially airtight manner by caps, said caps being suitable for co-operating with pressure measurement means, thereby making it possible for the pressures in said cells to be measured rapidly;

each of said caps includes a portion made of an elastomer that is suitable for being perforated and passed through in substantially airtight manner by a hollow needle, said hollow needle co-operating with pressure measurement means, thereby making it possible for the pressures in said cells to be measured rapidly; and/or the support device is provided with controlled air distribution means comprising at least one semi-rigid duct, forming an air distribution network, provided with a substantially rectilinear duct provided with perforations or with branches forming a plurality of nozzles perforated at their ends and extending in a direction that is substantially perpendicular to the longitudinal direction of said rectilinear duct, said perforations or said nozzles being suitable for distributing streams of air under the patient, when said controlled air distribution means are disposed under said cells and is connected to a fluid feed device, said controlled air distribution device sometimes comprising at least one said duct on either side of the mattress and connected to the same feed device.

BRIEF DESCRIPTION OF THE DRAWINGS

Other features and aspects appear from the following detailed description of an embodiment of the inflatable cell of the present disclosure and of a support device including such inflatable cells, given with reference to the accompanying drawings, in which:

FIG. 1 shows an individual inflatable cell according to the present disclosure, seen face-on;

DETAILED DESCRIPTION

Figure 1:
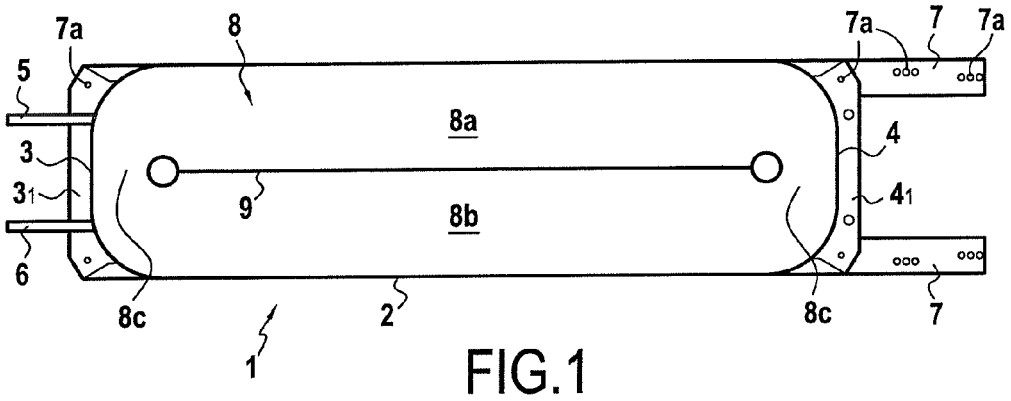

FIG. 1 shows an inflatable cell according to the present disclosure that is designated by overall reference 1. The cell 1 is inflatable by means of an inflation fluid such as a gas, such as air, that can be injected into the cell by any suitable means such as, for example, a turbine or a compressor.

The inflatable cell 1 comprises firstly a flexible tubular casing 2 that is illustratively elongate and closed at its ends 3, 4.

The cell further comprises at least one fluid insertion means 5 for inserting fluid into the cell and at least one fluid removal means 6, these fluid insertion and removal means being bonded in substantially airtight manner to at least one of the ends 3, 4 of the casing 2, and, for example, being constituted by two tube end-pieces made of a rigid or a semi-rigid plastics material, such as a co-extruded material based on EVA.

The inflatable cell 1 finally further comprises at least one, and in some embodiments at least two, and in further embodiments at least four attach or link means 7 for attaching or linking the cell 1 to another identical cell.

These attach or link means sometimes take the form of rectangular tongues that are integral with or secured to at least one end 3, 4 of the casing 2 as shown in FIG. 1.

Said attach or link means 7 are possibly formed integrally with the remainder of the casing 2 of the cell 1 while said cell is being manufactured, as described below.

The casing 2 of the cell 1 is, in the illustrated embodiment, constituted by a segment of tube or of sheath made of a thermoplastic material, in particular EVA or PUR, welded over its entire height at the two ends 3, 4 of the casing 2, and defining, between its walls, an inflatable chamber 8 that communicates with the outside of the cell 1 via end-pieces 5, 6 for inserting inflation fluid into the cell and for removing inflation fluid therefrom.

Typically, in order to provide that the cell 1 has good strength for withstanding the various forces to which it might be subjected the thickness of the walls of the tubular casing 2 lies in the range 150 μm to 350 μm.

In addition, the tongues 7 for linking the cell 1 to other identical cells are provided with reversible fastener means (not shown in FIG. 1) of the press stud type, or the clip type, or of the Velcro® fastener type, and suitable for co-operating with identical or complementary reversible fastener means on a link tongue 7 of another identical inflatable cell 1 so as to enable said identical cells 1 to be linked together reversibly.

The inflatable cell 1 is also provided with a middle longitudinal weld between the two ends 3, 4 of the casing 2 and over at least a portion of the length thereof, thereby separating the inflatable chamber 8 into two compartments, namely an upper compartment 8*a* and a lower compartment 8*b* in the form of inflatable sausage-shaped tubes, superposed and communicating at their ends 8*c* so that an inflation fluid with which the cell 1 is filled can flow easily between the two sausage-shaped tubes 8*a*, 8*b* of the chamber.

The middle longitudinal weld 9 makes it possible, starting from a tubular casing that has a substantially circular cross-section when it is inflated, to form two sausage-shaped tubes 8*a*, 8*b* of substantially identical diameter. The diameter of said sausage-shaped tubes 8*a*, 8*b* is substantially halved relative to the diameter of the initial tubular casing. The cell thus has a width (dimension in the longitudinal direction of the mattress) that is less than the height, depth, or thickness of the cell (dimension in the vertical direction of the mattress), thereby imparting improved rigidity to said cell. Starting from a tubular wall of substantially circular cross-section, it is thus possible to obtain a cell of width that is substantially half its height.

Said middle longitudinal weld 9 reinforces the structure of the cell 1 and, in particular, improves its strength and resistance to compression forces applied perpendicularly to the longitudinal midplane of the cell 1. The crush and deformation strength of the cell 1 is thus improved.

The inflatable cell 1 can be manufactured using a method that is extremely simple, productive, and economical.

In this method, firstly a segment of a tube or of a sheath made of a thermoplastic material such as EVA or PUR is selected, of a determined length that is slightly greater than the total length of the inflatable cell 1 that is to be obtained, and having walls of thickness lying in the range 150 μm to 350 μm.

The tube or sheath made of a plastics material used for making the cell can in particular be in the form of a roll or of a coil formed by rolling up the tube as flat after it has been extruded continuously, thereby making it easier to use for manufacturing inflatable cells of some embodiments, in particular automatically or semi-automatically.

After a segment of tube of suitable length has been selected, the walls of said segment of tube are welded together in two mutually distant zones over the entire width of the tube or of the sheath so as to form, in a single operation, the tubular casing 2, the ends 3, 4 thereof, and the link tongues 7 for the cell in alignment with said ends, the means 5, 6, for inserting fluid into the cell 1 and for removing fluid therefrom being assembled in substantially airtight manner to one of said ends 3, 4, simultaneously with the welding.

Once the welding has been performed, the segment of tube or sheath is cut off beyond its welded zones (in practice at the ends 3, 4 of the casing 2 and of the link tongues 7 obtained after welding) in order to obtain an inflatable cell 1.

So that the means for inserting fluid into the cell and for removing fluid therefrom are welded to the casing 2 while said casing is being made, at least one end-piece of tube 5 that is suitable for forming fluid insertion means and at least one end-piece of tube 5 that is suitable for forming fluid removal means are positioned at a cut end of the segment of tube or of sheath that is made of a thermoplastic material and that is chosen for forming the casing of a said inflatable cell.

The fluid insertion and removal tubes 5, 6 can be positioned in this way manually by an operator or automatically.

Optionally, the formed cell is cut out simultaneously with the welding of its ends. The cutting-out can, in particular, result either from the welding itself, or in some instances from a cutting member adjacent to the welding tools and actuated automatically either simultaneously with actuation of the welding tools or subsequently to actuation thereof so as to cut the cell out after welding from the sheath or tube made of a plastics material.

The attach or link tongue(s) 7 of the cell 1 are formed by welding together the flanks of the segment of tubular wall or sheath made of thermoplastic material and from which the casing 2 is formed, in alignment and in continuity with the ends 3, 4 of the chamber 8, simultaneously to forming of said ends 3, 4, and then by cutting out said tongues from the welded end zones $\mathbf{3}_1$, $\mathbf{4}_1$ that form said flanks that are welded together.

Similarly, the walls of the segment of tube or of sheath made of a thermoplastic material are welded together along a longitudinal middle line 9 of the casing 2 of the formed cell so as to subdivide the inflatable chamber 8 defined by said walls into two inflatable chambers 8*a*, 8*b* or inflatable sausage-shaped tubes that communicate with each other at their ends.

The length and the diameter of the sausage-shaped tubes 8*a*-8*b*, and thus the length and the width of the cells 1 can be respectively in the range 60 centimeters (cm) to 100 cm for the length and in the range 7 cm to 16 cm for the width, in order to form respective mattresses of width lying in the range 60 cm to 100 cm and of length lying in the range 115 cm to 220 cm with sausage-shaped tubes disposed transversely relative to the longitudinal direction of the mattress.

After the cell 1 has been cut out, reversible fastener means, in particular of the press stud type or of the clip type, as mentioned above, are installed manually or automatically on the link tongue(s) 7 of the casing 2 of the cell 1.

Figure 2:
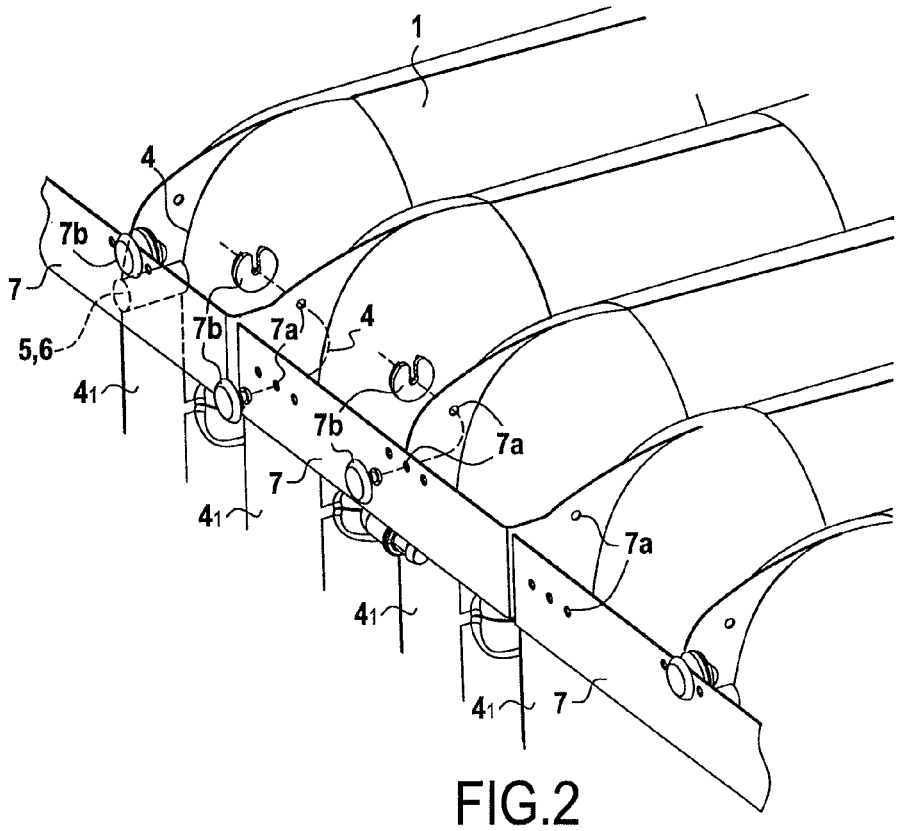
FIG. 2 is a perspective view of a support device according to the present disclosure for supporting an element to be supported, which device comprises an inflatable mattress made up of an assembly of a plurality of individual inflatable cells that are as shown in FIG. 1.

More particularly, in FIG. 2, said link means are constituted by said tongue 7 provided with perforations 7*a* and co-operating with rivets 7*b*, said rivets being suitable for co-operating in reversible fastening with perforations in another identical tongue or with perforations at the end of another cell, the two cells being disposed parallel to each other with their said link means at their ends on the same side.

It can be understood that, in this example, said perforations 7*a* constitute reversible fastener means and said rivets 7*b* constitute complementary reversible fastener means, co-operating with said reversible fastener means 7*a* to form a said reversible fastening.

More precisely, rivets 7*b* co-operate with perforations 7*a* in the tongue 7 of a cell and with perforations 7*a* at the end of the next cell. Thus, rivets 7*b* make it possible to attach a tongue 7 of one cell through perforations 7*a* in two other following cells, the perforation 7*a* in the second following cell being a perforation in the tongue of the link means 7 of said second following cell, while the first following cell is not provided with any tongue on this side.

The main but not exclusive purpose of the inflatable cell 1 of the illustrative embodiment is to enable support devices of the therapeutic mattress type having inflatable cells to be manufactured at a low cost relative to the cost of manufacturing currently existing support devices of this type for supporting the bodies of patients presenting risks of bedsores forming or worsening both in hospital and at home.

Figure 4A:
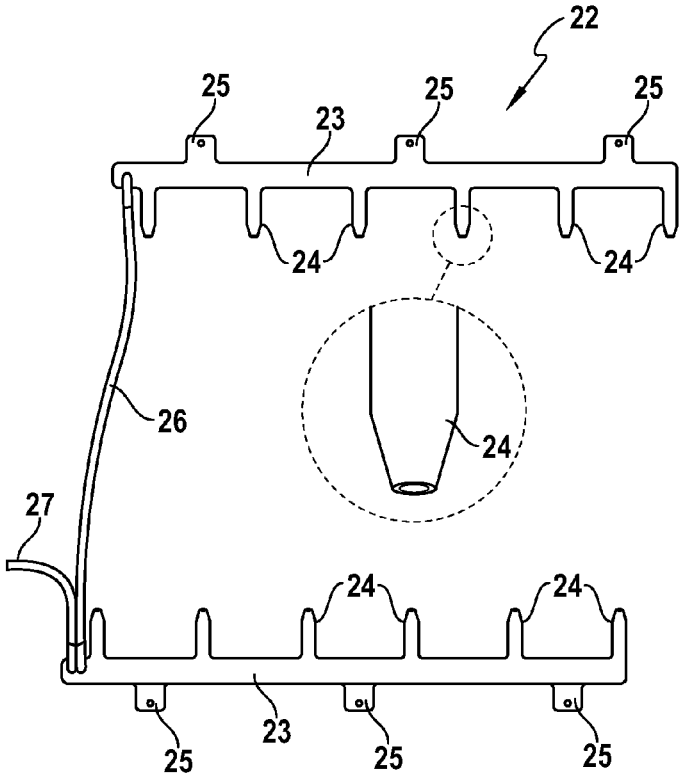
FIGS. 4A and 4B show an air distribution device that is typically of the Low Air Loss type and that is incorporated into the support device shown in FIG. 2, under the inflatable mattress of the support device.
Figure 4B:
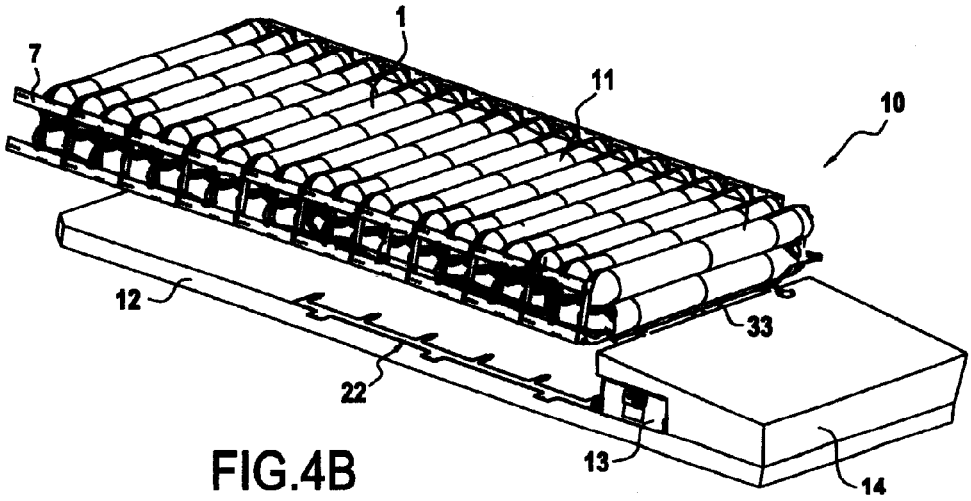

To this end, this disclosure proposes such a support device such as that shown in one embodiment in FIG. 2 or in FIG. 4B and designated by overall reference 10.

This support device 10 illustratively comprises an upper layer for supporting a person's body, which layer is constituted by an inflatable mattress 11 made up of a plurality of inflatable cells 1 identical to the cell described above and shown in FIG. 1 and rests on a lower layer for supporting the inflatable mattress 11, which layer is, for example, constituted by a foam mattress 12, in particular a polyurethane foam mattress, the density of the foam being chosen to stiffen the support device 10 and to take up to a good extent the forces applied by the body of a person recumbent on the cells 1 of the inflatable mattress 11.

The support device 10 further comprises an automatic inflation system 13 for automatically inflating the mattress 11, which system is placed in a rigid console or housing 14 resting on the foam mattress 12 in alignment with the inflatable mattress 11.

The inflatable mattress 11, the foam mattress 12, and the inflation system 13 are optionally inserted into a removable protective cover that is not shown in FIG. 2.

The inflatable mattress 11 is made up of a plurality of inflatable cells 1 in the illustrative example, and sometimes in the range of 3 identical inflatable cells to 24 substantially identical inflatable cells, the mattress 11 shown in FIG. 2 or in FIG. 4B having 19 substantially identical inflatable cells.

The cells 1 are assembled together at their ends 3, 4 via their link tongues 7 provided with complementary reversible fastener means, in particular press studs, or indeed plastic rivets.

The cells 1 are thus pressed and held against one another over their side faces such that their respective longitudinal welds 9 separating their inflation chambers 8 into superposed compartments 8*a*, 8*b* lie substantially in the same horizontal plane that forms a longitudinal midplane for the inflatable mattress 11, when no patient is on the mattress.

The inflatable cells 1 of the mattress 11 of the support device also communicate with one another at their fluid insertion and removal means 5, 6 and with the inflation device 14 via pneumatic connection means such as ducts and valves establishing communication between the inflation chambers 8 of all of the cells 1 and suitable for conveying inflation fluid (air, in practice) and, where applicable, for transferring it between the inflation cells 1.

The connection means form a pneumatic circuit that comprises, in particular, at least one fluid feed pipe connected to the fluid insertion means 5 of the cells 1 and at least one fluid removal duct connected to the fluid removal means 6 of the cells 1. The connection means further comprise at least one solenoid valve making it possible to control the fluid feed and/or fluid discharge for the cells 1 in order to regulate the inflation pressure thereof.

More practically, the pneumatic communications between the various cells 1 and the inflation device 14 are optionally established in the manner described below and shown in FIGS. 5A and 5B for an inflatable mattress 11 having twenty cells 1.

Figure 5A:
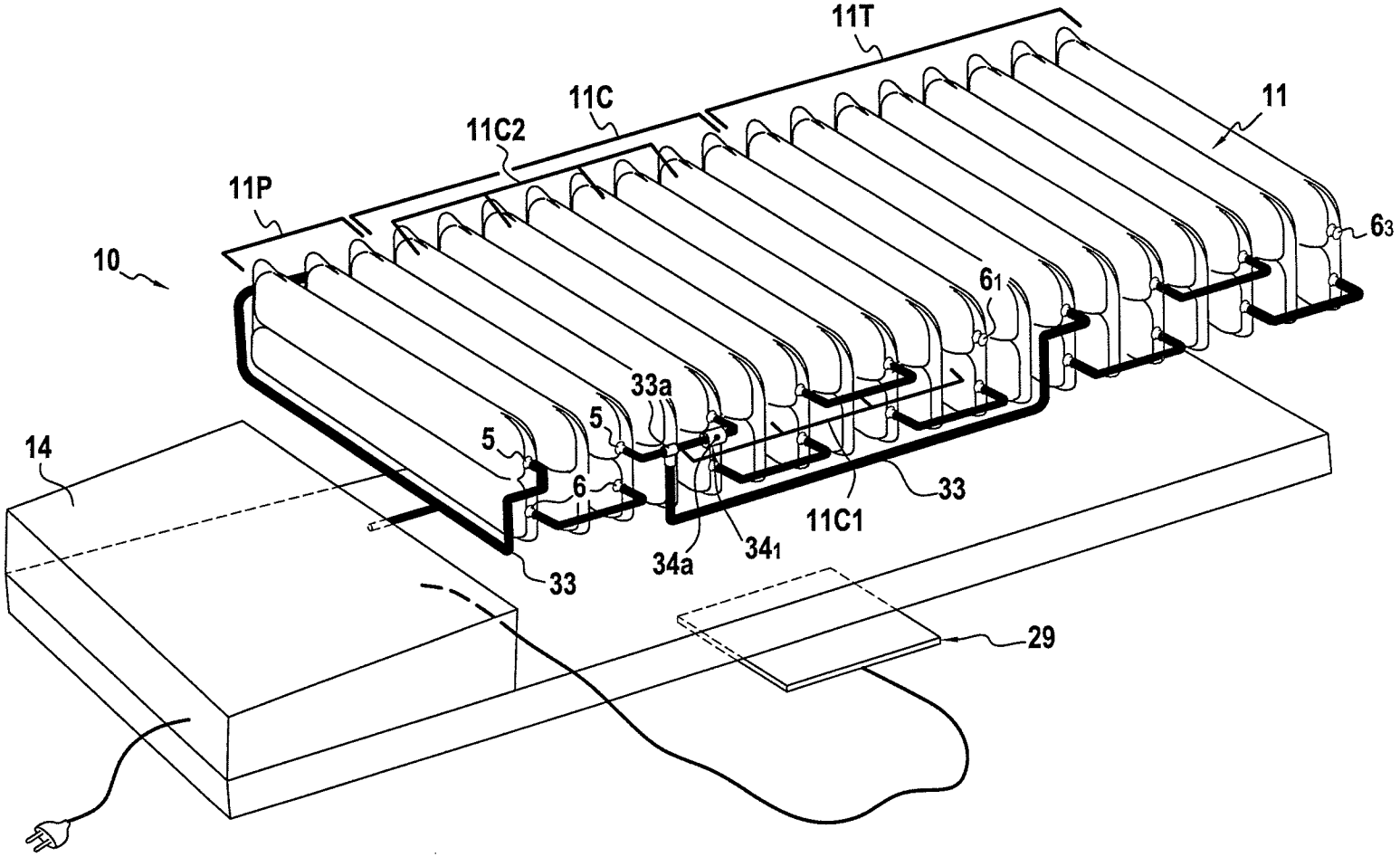
FIGS. 5A and 5B diagrammatically show the hydraulic connection network for the inflatable cells of the mattress of the support device of the present disclosure in an illustrative embodiment.
Figure 5B:
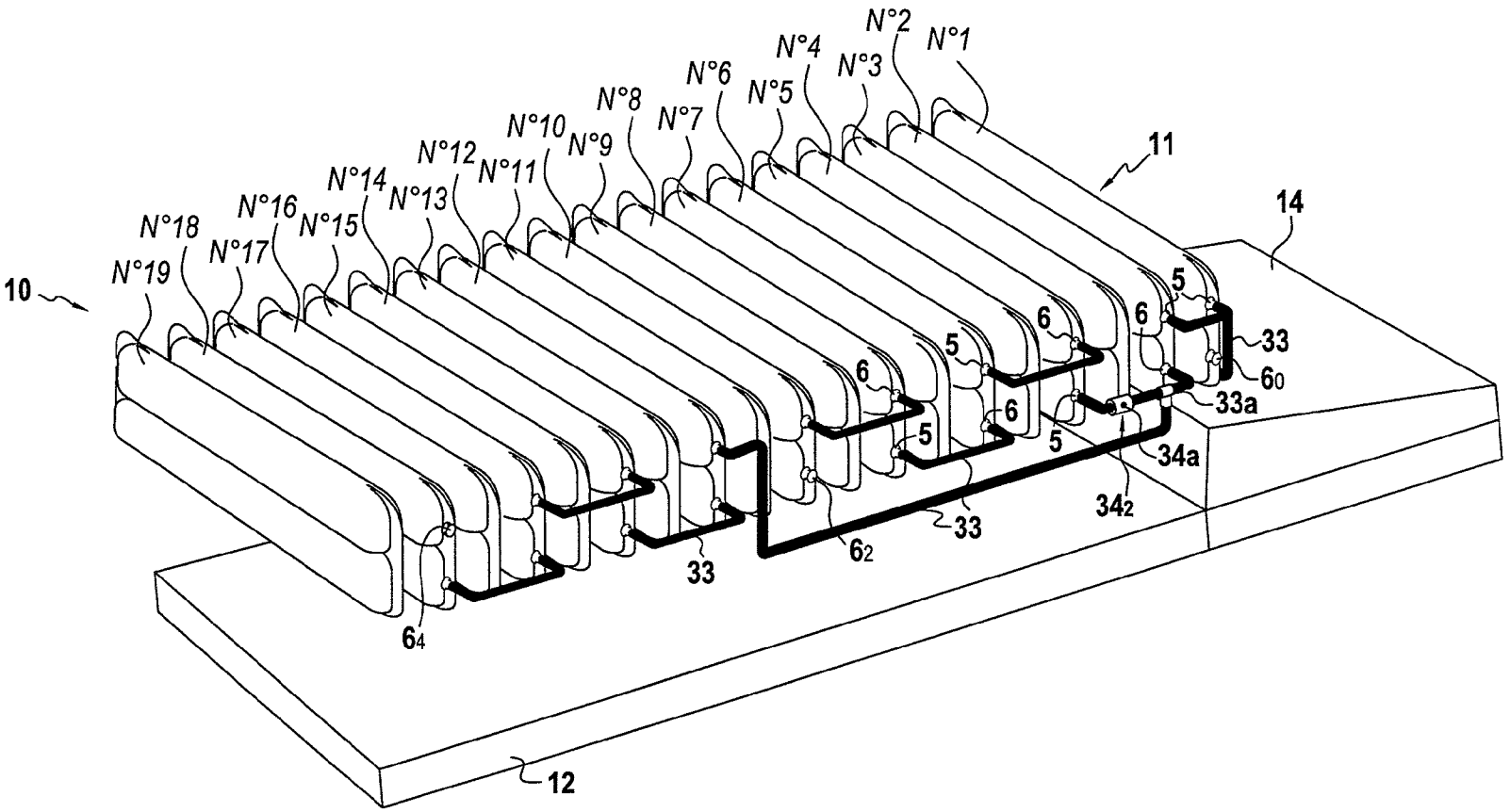

FIGS. 5A and 5B show a therapeutic mattress 11 equipped with an inflation device 14 as contemplated by this disclosure.

The therapeutic mattress 11 is made up of 19 inflatable cells that are disposed transversely to the longitudinal direction of the mattress. Each cell is made up of two compartments, namely an upper compartment and a lower compartment, said upper and lower compartments being in the form of sausage-shaped tubes and communicating with each other at their ends.

The mattress 11 shown in FIGS. 5A and 5B comprises the following three zones: a foot zone 11P made up of the first three cells (cells Nos. 1 to 3); a central zone 11C made up of eight cells (cells Nos. 4 to 11); and a head zone 11T also made up of eight cells (cells Nos. 12 to 19).

The central zone 11C corresponds to a zone inflated using an alternating inflation method as described herein.

The central zone 11C comprises a first series of cells or "first cells" 11C1 (cells Nos. 5, 7, 9 and 11) and a second series of cells or "second cells" 11C2 (cells Nos. 4, 6, 8 and 10).

The cells of each of said first and second series 11C1 and 11C2 are connected in series, i.e. in line, the two series being connected in parallel, fed by the same inflation device 14.

More precisely, each of the cells of the mattress 11 is provided with an inlet orifice and with an outlet orifice (not shown). The inlet or feed orifice is situated at one end of the upper compartment, in the transverse direction of the mattress, the outlet or removal orifice being situated at the same-side end of the lower compartment, in the transverse direction of the mattress (or in the longitudinal direction of the cell). Two adjacent cells have their orifices disposed at opposite ends in the transverse direction of the mattress and they belong to different series of cells.

Thus, in FIG. 5A, it can be seen that cell No. 1 at the foot of the mattress is fed via a pipe 33 at the end 5 of the upper compartment of cell No. 1, and the end 6 of the same side of the lower compartment of cell No. 1 communicates directly with the end of the lower compartment on the same side of cell No. 3, whose same-side end of the upper compartment communicates, starting from a T-branch fitting 33*a*, firstly with a first solenoid valve $\mathbf{34}_1$, starting from which cells Nos. 5, 7, 9, and 11 of said first series 11C1 of cells are disposed in series, and secondly, connected in parallel with the cells 11C1, with the same-side end of the upper compartment of cell No. 13, which is the second cell of the head zone 11T starting from the foot of the bed, the other cells of the head zone Nos. 15, 17, and 19 being connected one after another in series.

Symmetrically, in FIG. 5B, it is shown that cell No. 2 of the foot zone 11P is fed, at the opposite end of the upper compartment, from the device 14, via the same pipe 33. And the same-side end of the lower compartment of cell No. 2 of the foot zone 11P feeds a T-branch fitting 33*a*, from which the following are fed in parallel: firstly the second solenoid valve $\mathbf{34}_2$, from which cell No. 4 of the mattress, representing the first cell of said second series of cells 11C2, is fed, the other cells of the second series of cells 11C2, namely cells Nos. 6, 8, and 10, being fed in series, i.e. communicating with one another in series symmetrically and parallel to said first series of cells 11C1; and secondly a pipe 33 that feeds the end of the upper compartment of the first cell No. 12 of the head zone, the same-side end of the lower compartment of the following second cell of the head zone, namely cell No. 14 starting from the foot of the bed, being fed from the same-side end of the lower compartment of cell No. 12, and so on, in series on to cell No. 16 and then on to the penultimate cell No. 18 of the head zone 11T.

It can thus be seen that the cells of the head zone 11T and of the foot zone 11P constitute third cells that are situated upstream of the first and second solenoid valves $\mathbf{34}_1$ and $\mathbf{34}_2$.

The solenoid valves $\mathbf{34}_1$ and $\mathbf{34}_2$ are shown disposed in line between the pipes 33 and the orifices of the first cells of said first series 11C1 and of said second series of cells 11C2. However, they could be disposed in specific housings.

Said first and second solenoid valves $\mathbf{34}_1$ and $\mathbf{34}_2$ are 3-port solenoid valves of the 3/2 type, as described above.

This organization of the various cells of the mattress in two series of cells 11C1 and 11C2 that are connected in parallel but that are disposed such that the cells of said first series 11C1 and of said second series 11C2 succeed one another in alternation, and with the two series being controlled by different solenoid valves, makes it possible to facilitate implementation of the alternating inflation method described herein, while minimizing the space occupied around the mattress by the network of pipes and other means for establishing hydraulic communication between the cells.

In order to control and to achieve the inflation/deflation of the cells 1 of the support device, the inflation device in the housing 14 comprises, in conventional manner, at least one air compressor and means for measuring the inflation pressures in the cells that are electrically connected to an electronic control and regulation device 13 that is received, like the remainder of the inflation device, in particular the compressor, in a block of foam at the foot of the support device 10 in alignment with the mattress 11.

The electronic control and regulation device 13 makes it possible to control both the air compressor and the solenoid valves of the pneumatic circuit for inflating the support device so as to inflate/deflate the cells 1 as a function of the air pressures in the cells and also of the pressures applied by the body of a person recumbent on the inflatable mattress 11.

Such pressures applied by the body of a person recumbent on the mattress 11 are measured by means of at least one sensor 29, such as the sensor described, for example, in the Applicant's European Patent EP 0 676 158, disposed between the inflatable mattress 11 and the foam mattress 12 or under the foam mattress 12 and also connected to the electronic control device, which, by comparing the air pressures measured in the cells with the pressures applied to the cells by the body of a person operates the compressor and the solenoid valves so as to adjust the inflation pressure of the cells 1.

In known manner, the electronic control device of the automatic inflation system 13 can be configured to implement and maintain an "alternating-pressure" inflation mode for certain cells 1 of the inflatable mattress 11 of the support device 10, and, in particular, for the cells 1 serving to support the sacral zone of a patient, which cells are generally the cells 1 of the central zone of the mattress 11.

In such an "alternating-pressure" inflation mode, for example, one in every two cells of the sacral support zone for supporting the sacral zone of the patient are deflated and then re-inflated, and then the cells adjacent to the preceding cells that have been deflated and then re-inflated are in turn deflated and then re-inflated.

Thus, each cell 1 of the mattress 11 in the alternating-pressure regulated support zone of the mattress 11 is successively and progressively deflated and then re-inflated, generating a kind of wave moving back and forth in the longitudinal direction of the mattress 11 and massaging the patient, thereby facilitating blood circulation through the soft tissue of the body at the interface with the mattress while the cells are being re-inflated, or minimizing the effects of ischemia, in particular anoxia or hypoxia, while the compartments are being deflated.

Figure 3A:
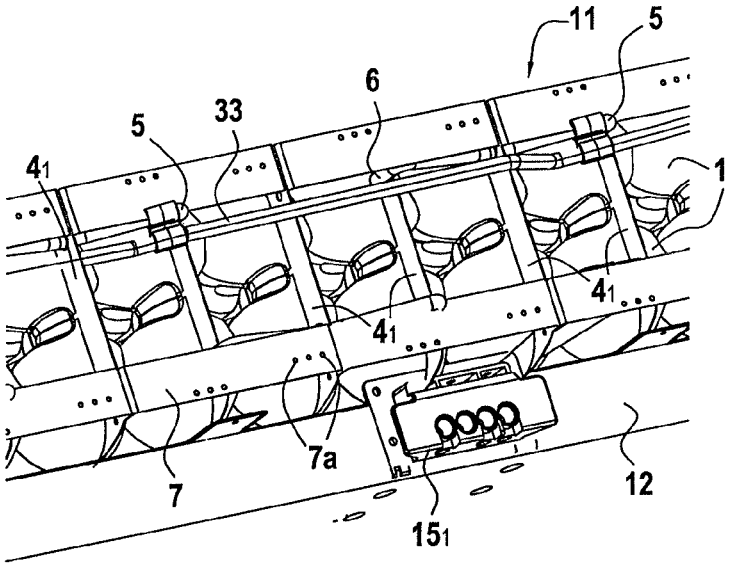
FIGS. 3A and 3B are views of a construction detail of the support device of FIG. 2, showing the structure and the positioning of a Cardio-Pulmonary Resuscitation (CPR) rapid deflation valve for rapidly deflating the cells of the inflatable mattress of the support device.
Figure 3B:
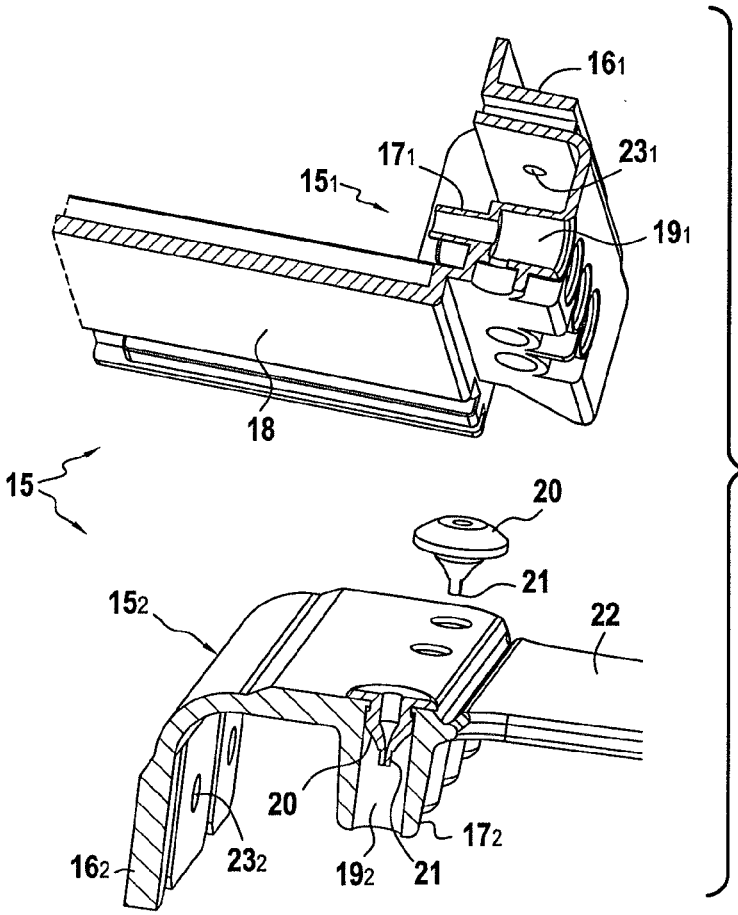

As shown in detail in FIGS. 3A to 3B, the support device 10 also comprises a manual emergency deflation valve 15 for deflating at least some of the inflatable cells 1 of the mattress 11. Such an emergency deflation valve is generally known as a "CPR" (Cardio-Pulmonary Resuscitation) valve;

Such a CPR valve makes it possible, when it is actuated, to deflate simultaneously and very rapidly the cells supporting the torso of a patient recumbent on the mattress so that the patient can be given a heart massage on a rigid surface rather than on the inflatable cells of the support device.

The manual CPR valve 15 includes a fastener first piece $\mathbf{15}_1$ that is essentially made up of first perforated end-pieces $\mathbf{17}_1$. These first end-pieces $\mathbf{17}_1$ are perforated with through cylindrical orifices $\mathbf{19}_1$.

In FIGS. 3A and 3B, said fastener piece $\mathbf{15}_1$ has four said rigid first end-pieces $\mathbf{17}_1$. Said first end-pieces $\mathbf{17}_1$ are designed to be inserted into removal orifices of said cells and/or into the ends of small hydraulic transfer pipes or hoses communicating at their other ends with said removal orifices of said cells. Said fastener first piece $\mathbf{15}_1$ illustratively has a base or a support plate 18 enabling it to be fastened to the mattress. The base or plate 18 is slid under the foam mattress 12 and co-operates in clamping with a backing plate (not shown) positioned above the foam mattress 12 and enabling it to be fastened securely around the foam mattress 12, on which the inflatable mattress 11 rests, the foam mattress 12 being clamped between the plate 18 and the backing plate (not shown).

The manual CPR valve 15 also includes a second piece $\mathbf{15}_2$, or removable piece $\mathbf{15}_2$, having second end-pieces $\mathbf{17}_2$ suitable for stopping said first cylindrical orifices $\mathbf{19}_1$ of the first end-pieces $\mathbf{17}_1$, and a handle 22 suitable for making it possible to pull said removable piece $\mathbf{15}_2$ so as to extract said second end-pieces $\mathbf{17}_2$ from said first orifices $\mathbf{19}_1$, so as to enable the cells 1 of the mattress communicating with said first end pieces $\mathbf{17}_1$ to be deflated in accelerated manner.

By being fastened securely, said fastener piece $\mathbf{15}_1$ makes it possible to facilitate actuation of the handle 22 for releasing the piece $\mathbf{15}_2$ from the piece $\mathbf{15}_1$. The removable piece $\mathbf{15}_2$ is made of a more flexible plastics material, in particular of a styrene-ethylene-butadiene-styrene (SEBS) elastomer or of an ethylene-propylene-diene-monomer (EPDM) elastomer, while the fastener piece $\mathbf{15}_1$ is made of a more rigid material, in particular of acrylonitrile-butadiene-styrene (ABS) or of polycarbonate (PC). The removable piece $\mathbf{15}_2$ is fastened to the fastener piece $\mathbf{15}_1$, by adapting and fastening the portion $\mathbf{16}_2$ of the piece $\mathbf{15}_2$ against the portion $\mathbf{16}_1$ of the piece $\mathbf{15}_1$, via rivets co-operating with the orifices $\mathbf{23}_1$ of the pieces $\mathbf{15}_1$ and orifices $\mathbf{23}_2$ of the piece $\mathbf{15}_2$, the orifices $\mathbf{23}_1$ and $\mathbf{23}_2$ being put into correspondence, so that, by pulling on the handle 22, it is possible to disengage the second end-pieces $\mathbf{17}_2$ from the first orifices $\mathbf{19}_1$.

In FIG. 3B, the moving piece $\mathbf{15}_2$ includes three second end-pieces $\mathbf{17}_2$ each of which is also perforated with a respective second cylindrical orifice $\mathbf{19}_2$ through said end-piece and receiving a removable cap 20 suitable for closing off said second end-pieces $\mathbf{19}_2$ in substantially airtight manner.

In FIG. 3B, each of the removable caps 20 has an inner end 21 inside a corresponding one of said second cylindrical orifices $\mathbf{19}_2$. Since said end 21 is made of a fluorocarbon-containing perforatable material, a hollow needle connected to a pressure measurement device can pass through it, so that it is possible rapidly to measure the pressures in the cells communicating with said end-pieces $17_1$. In a variant, it is possible to replace the caps 20 with ball valves of the type used for inflating footballs, inserted into said second end-pieces $17_2$ of the removable piece $15_2$, so as to enable an accessory system to be connected rapidly for measuring and/or inflating cells 1 of a mattress 11.

After removing the moving piece $15_2$ from the fastener piece $15_1$ or after removing the caps 20, it is possible to re-inflate the mattress rapidly by means of an accessory fluid injection device connected in said first orifices $19_1$.

It can be understood that said fastener first piece $15_1$ constitutes an interface piece between said removable piece $15_2$, carrying stoppers and orifices communicating with the cells. By means of said fastener first piece $15_1$ being held securely relative to the mattress, it is quick and easy for all of the orifices closed off by said removable piece $15_2$ to be opened suddenly and rapidly.

In FIGS. 3A and 3B, the manual valve device 15 has four said first end-pieces $17_1$ suitable for co-operating with four portions of hydraulic connection pipe. In a first embodiment, the four hydraulic connection pipes are connected to cells Nos. 9, 10, 11, and 12, in particular with a closed-off tubular removal/feed end-piece $6_1$ of cell No. 9 and a closed-off removal/feed end-piece $6_2$ of cell No. 10 on the opposite side. The manual valve 15 can also communicate with removal/feed end-pieces disposed on the opposite sides of cells Nos. 11 and 12 of the zone 11C, or with the unused closed-off feed/removal end-pieces $6_0$, $6_3$, and $6_4$ of cells Nos. 1, 19, and 18.

As shown in FIG. 4, the support device 10 of the illustrative embodiment is also provided with a controlled air distribution device 22 for distributing air in controlled manner between the cells, and generally known as a "Low Air Loss" device.

The controlled air distribution device 22 is designed to convey and to distribute the volume of air generated by the air compressor with a view to providing air circulation inside the patient support device in order to limit the development of dampness both in said support device and at the interface with the patient through the removable protective cover.

In another embodiment, the device is limited to a vulnerable zone to be treated (in particular the sacral zone, for example).

This controlled air distribution device comprises in particular one, and in some embodiments, as shown in FIG. 4, at least two semi-rigid ducts 23 disposed under the inflatable cells 1 of the mattress 11 and on the foam mattress 12 and connected to the air compressor of the inflation system 13. The ducts 23 are provided with nozzles 24 projecting from their surfaces, said nozzles 24 being perforated at their pointed ends in a manner such as to distribute steams of air under the inflatable cells 1 of the mattress 1 of the support device. In a variant, the nozzles 24 can be replaced with holes in a pipe forming the duct 23 that is provided with holes at a defined pitch.

The air diffusion flow-rate through the nozzles 24 is determined primarily by the aperture diameter of said nozzles 24 that can lie in the range 1 millimeter (mm) to 3 mm as a function of the flow-rate of the air compressor used.

The ducts 33 are optionally disposed parallel to each other along the longitudinal edges of the foam mattress 12 of the support device with their nozzles 24 facing one another. They are also optionally provided with fastener tabs 25 via which they can be fastened, such as removably, to the foam mattress 12 by suitable fastener means and/or to the ends of said cells.

The ducts 23 are, in addition, connected together via a pipe 26 that makes it possible for pneumatic communication to be established between the two pipes 22, a second pipe 27, also secured to one of the two ducts 23, making it possible to connect the controlled air distribution device to the compressor of the inflation system 13 of the support device 10 of the disclosed embodiment.

The invention claimed is:

1. A mattress for supporting a person, the mattress comprising a cover defining an interior region, a plurality of laterally extending inflatable bladders in the interior region of the cover; and an air distributor located in the interior region of the cover, the air distributor having a plurality of nozzles oriented laterally and through which air is injected into the interior region of the cover outside each of the plurality of laterally extending inflatable bladders, wherein the air distributor comprises at least one duct from which at least some of the plurality of nozzles extend, wherein the at least one duct comprises a first duct situated adjacent a first side of the mattress and a second duct situated adjacent a second side of the mattress.

2. The mattress of claim 1, wherein at least some of the air injected from the nozzles is distributed between the laterally extending inflatable bladders.

3. The mattress of claim 1, wherein the air injected from the nozzles is circulated inside the cover so as to limit the development of dampness inside the cover and at an interface between the cover and a patient.

4. The mattress of claim 1, wherein the air distributor is located within a sacral zone of the mattress.

5. The mattress of claim 1, wherein the at least some of the plurality of nozzles extend in substantial perpendicular relation with the at least one duct.

6. The mattress of claim 1, wherein the air distributor further comprises fastener tabs extending from the at least one duct in a direction opposite to that of the plurality of nozzles.

7. The mattress of claim 1, further comprising a layer of foam and the air distributor being situated above the foam.

8. The mattress of claim 7, wherein the air distributor is situated beneath at least some of the plurality of laterally extending inflatable bladders.

9. A mattress for supporting a person, the mattress comprising a cover defining an interior region, at least one inflatable bladder in the interior region of the cover; and an air distributor located in the interior region of the cover, the air distributor having a plurality of nozzles that are oriented substantially parallel to each other and through which air is injected into the interior region of the cover outside the at least one inflatable bladder, wherein the air distributor comprises at least one duct from which at least some of the plurality of nozzles extend, wherein the at least one duct comprises a first duct situated adjacent a first side of the mattress and a second duct situated adjacent a second side of the mattress.

10. The mattress of claim 9, wherein at least some of the air injected from the nozzles is distributed around the at least one inflatable bladder.

11. The mattress of claim 9, wherein the air injected from the nozzles is circulated inside the cover so as to limit the development of dampness inside the cover and at an interface between the cover and a patient.

12. The mattress of claim 9, wherein the air distributor is located within a sacral zone of the mattress.

13. The mattress of claim 9, wherein the at least some of the plurality of nozzles extend in substantial perpendicular relation with the at least one duct.

14. The mattress of claim 9, wherein the air distributor further comprises fastener tabs extending from the at least one duct in a direction opposite to that of the plurality of nozzles.

15. The mattress of claim 9, further comprising a layer of foam and the air distributor being situated above the foam.

16. The mattress of claim 15, wherein the air distributor is situated beneath the at least one inflatable bladder.

17. A mattress for supporting a person, the mattress comprising a cover defining an interior region, at least one inflatable bladder in the interior region of the cover; and an air distributor located in the interior region of the cover, the air distributor having a plurality of nozzles that are oriented substantially parallel to each other and through which air is injected into the interior region of the cover outside the at least one inflatable bladder, each nozzle of the plurality of nozzles having a tapered shape and terminating at an end that is perforated.

* * * * *